US005490501A

United States Patent [19]

Crowley

[11] Patent Number: 5,490,501

[45] Date of Patent: Feb. 13, 1996

[54] AVALANCHE VICTIM'S AIR-FROM-SNOW BREATHING DEVICE

[76] Inventor: Thomas J. Crowley, 11351 E. Amherst Ct., Aurora, Colo. 80014

[21] Appl. No.: 243,237

[22] Filed: May 16, 1994

[51] Int. Cl.[6] ..... A62B 25/00

[52] U.S. Cl. ..... 128/204.17; 128/200.24; 128/201.29; 128/207.14

[58] Field of Search ..... 128/200.24, 201.11, 128/201.13, 201.29, 202.13, 202.19, 204.17, 205.27, 206.15, 206.16, 206.17, 207.14

[56] References Cited

U.S. PATENT DOCUMENTS

| | | | |
|---|---|---|---|
| 3,762,407 | 10/1973 | Shonerd | 128/142.3 |
| 4,019,507 | 4/1977 | Oetjen et al. | 128/142 R |
| 4,062,359 | 12/1977 | Geaghan | 128/204.17 |
| 4,090,509 | 5/1978 | Smith | 128/202.19 |
| 4,164,218 | 8/1979 | Martin | 128/142.7 |
| 4,365,628 | 12/1982 | Hodel | 128/205.12 |
| 4,683,869 | 8/1987 | Wilcox | 128/204.17 |
| 4,794,923 | 1/1989 | Bartos | 128/205.24 |
| 4,840,170 | 6/1989 | Dahrendorf et al. | 128/202.26 |
| 4,917,081 | 4/1990 | Bartos | 128/205.12 |
| 4,938,211 | 7/1990 | Takahashi et al. | 128/204.26 |
| 4,960,120 | 10/1990 | Constance-Hughes | 128/205.22 |
| 4,964,405 | 10/1990 | Arnoth | 128/205.17 |
| 4,996,982 | 3/1991 | Williamson | 128/205.24 |
| 5,027,810 | 7/1991 | Patureau et al. | 128/206.24 |
| 5,036,841 | 8/1991 | Hamilton | 128/202.26 |
| 5,036,842 | 8/1991 | van der Smissen et al. | 128/204.18 |
| 5,063,923 | 11/1991 | Peroni | 128/200.24 |
| 5,065,745 | 11/1991 | Meier | 128/205.12 |
| 5,099,835 | 3/1992 | Nelepka | 128/204.18 |

FOREIGN PATENT DOCUMENTS

| | | | |
|---|---|---|---|
| 21424 | 5/1883 | Germany | 128/204.17 |
| 8203013 | 9/1982 | WIPO | 128/204.17 |

OTHER PUBLICATIONS

Falk et al. Avalanche Survival Chances. Nature (Periodical) V.368, p. 321, Mar. 3, 1994. D. Curtin, Avalanche, Survival Not Just Luck. Denver Post (Newspaper), Spring '94.

*Primary Examiner*—Ren Yan
*Assistant Examiner*—William J. Deane, Jr.

[57] ABSTRACT

This describes an emergency breathing device for a person buried in snow. Snow contains considerable air. The person inhales through a mouthpiece connected via tubing and a one-way valve to an inhalation chamber. The surface of the inhalation chamber is covered by an inhalation membrane permeable to air but not to snow. The snow-contacting surface of the inhalation membrane is sufficiently large to pass, under normal respiratory pressure gradients, enough air from the snow for normal inhalation. The buried person exhales through the same mouthpiece, which separately connects via tubes and a one-way valve to an exhalation chamber. The exhalation chamber is covered by an exhalation membrane permeable to air but not to snow. The snow-contacting surface of the exhalation membrane is sufficiently large to pass, under normal respiratory pressure gradients, the exhaled air from the exhalation chamber to the snow. The user wears the device on an outer garment, activating it simply by placing the mouthpiece in the mouth. The inhalation and exhalation chambers are located sufficiently far apart on the garment to minimize mixing of previously exhaled air with air for inhalation. The light weight and mechanical simplicity of the device make it easy for a skier to carry, wear, and use.

18 Claims, 2 Drawing Sheets

AVALANCHE VICTIM' S AIR-FROM-SNOW BREATHING DEVICE

BACKGROUND

1. Field of the Invention

This invention generally pertains to emergency breathing devices, and specifically to devices for breathing by persons buried in snow.

2. Description of Related Art

Avalanches are the chief causes of snow burial. Such burials kill many highway and railroad workers, backcountry skiers and snowshoers, and mountain residents each year. Annual avalanche mortality estimates have been 35–40 persons in Switzerland, about the same number in Austria, 31 in France, about 30 in Japan, 20–30 in Italy, 17 in the United States, 10–15 in Norway, about 10 in Germany, and 7 in Canada. In a 1994 article in the journal Nature, Falk et al. still estimated 150 avalanche deaths annually in the Alps. Colorado has the most avalanche deaths among American states. About 500 persons have died in Colorado avalanches, and in the heavy snows of 1992–1993 Colorado recorded 12 avalanche deaths.

An additional hazard for snow burial is the collapse of "tree wells", which are steep-sided pits of snow around coniferous trees. Skiers sometimes fall into tree wells as they pass a tree, and the collapsing snow then covers the person.

Of persons totally buried in snow with no tell-tale sign to the surface such as a protruding ski, three out of four will not survive. About one-third of avalanche victims die from the trauma of being dragged into trees or rocks. The rest die of suffocation beneath the snow. Suffocation is quick; only 30 percent survive 35 minutes'burial. In their 1994 article in Nature, Falk et al. call for the development of ". . .self-help techniques to facilitate creation of a life-saving air pocket, which would give the skier a relatively safe haven . . ."

Many emergency breathing devices aim to remedy polluted or oxygen-deficient air, such as smoky buildings or methane-filled mines. Others address surroundings with little or no breathable air, such as high-altitude or underwater conditions. Approaches include various combinations of filtering pollutants from incoming air, supplying fresh oxygen from chemical or compressed-gas sources, or rebreathing of expired air, sometimes after removal of carbon dioxide. U.S. Pat. No. 4,019,507issued to Oetjen et al in 1977 describes an example of a filtering device; it filters incoming air and mixes it with chemically-supplied oxygen. Similarly, U.S. Pat. Nos. 5,036,842 to van der Smissen et al. in 1991 and 5,065,745 to Meier in 1991 use motorized blowers to move polluted air through filters. But such heavy, mechanized devices are impractical for wilderness skiers and snowshoe enthusiasts, who constantly must carry all of their equipment on their backs.

Various patents describe emergency breathing devices containing oxygen sources. U.S. Pat. No. 439,093 issued to Barian in 1890 used a simple sealed bag to hold a supply of air at standard pressure. Others describe air or oxygen supplies in compressed-gas cylinders. The later include these U.S. Pat. Nos. 3,762,407 issued to Shonerd in 1973; 4,802,472 to Jung in 1989; 4,821,712 to Gosset in 1989; 4,887,591 to Okumura in 1989; 4,960,120 to Constance-Hughes in 1990; 4,996,982 to Williamson in 1991; and 5,099,835 to Nelepka in 1992. But before rescue an avalanche victim may be buried for some minutes to several hours. Large compressed-gas cylinders are too heavy to be carried by skiers, and small ones may be emptied before rescue occurs. Moreover, some 50–95 percent of snow's volume is air, pollutant-free and needing no filtering. Devices with self-contained oxygen sources obviously do not utilize that air in the snow.

U.S. Pat. No. 1,814,506 issued to Davis in 1929 extended the duration of air supply through rebreathing. The person extracts more oxygen from the air by rebreathing expired air after chemicals remove carbon dioxide. U.S. Pat. No. 2,852,023 issued to Hamilton et al in 1958 0 added a compressed gas supply to replenish oxygen in rebreathed air. Further refinements were offered by these U.S. Pat. Nos. 3,976,063 issued to Henneman et al in 1976; 4,163,448 to Grouard in 1979; 4,794,923 to Bartos in 1989; 4,917,081 to Bartos in 1990; 4,938,211 to Takahashi et al in 1990; 4,964,404 to Stone in 1990; 4,964,405 to Amoth in 1990; 5,036,841 to Hamilton in 1991; and 5,027,810 to Patureau et al in 1991. But clean air is plentifully available in snow; it need not be rebreathed. And the weight and mechanical complexity of these rebreathing devices, which may be excellent for fireman or miners, make them impractical for wilderness skiers.

Neither are the skier's problems of weight, size, and mechanical complexity solved by chemically-generated oxygen supplies. Examples of the latter appear in these U.S. Pat Nos. 2,444,029 issued to Bowen in 1948; 4,164,218 to Martin in 1979; and 4,840,170 to Dahrendorf et al in 1989. The self-contained chemical oxygen supply is heavy, and the considerable heat produced in these exothermic reactions might burn the buried, immobile avalanche victim.

All of the above devices were designed for firemen, miners, aviators, and other non-skiers. U.S. Pat. No. 4,365,628, issued in 1982 to Hodel, described an emergency-breathing device with many of the above features for avalanche victims. Skiers would wear this device, with its compressed gas supply, carbon-dioxide scrubber, and spring-loaded valves, on a vest. It did not utilize the air contained in snow. It was too heavy and complex to find wide use.

Although appropriate for brief use by miners, fireman, aviators, etc., the above emergency breathing devices have major disadvantages for backcountry skiers, snowshoe travellers, ski patrol workers, and others exposed to avalanche hazards:

First, devices with filters, oxygen canisters, pressure valves, chemical supplies of oxygen, etc., are unacceptably heavy for backcountry travellers. Miners and others may stow emergency breathing equipment in convenient places, donning the equipment only in an emergency. Thus, within reason weight is a minor consideration for them. But for backcountry travel a skier must constantly carry the breathing equipment, together with food, sleeping bags, and other gear. So light weight is crucial for avalanche breathing devices.

Second, many previous devices require too much time to don or activate. Avalanche breathing devices must be instantly usable. Skiers frequently are swept away without warning. The victim must begin using the device before the snow stops moving, often in a very few seconds, because most victims are immobilized by the packed snow once sliding ends.

Third, even seemingly simple procedures for activating previous devices may be much too complex for the panicked avalanche victim suddenly being swept along under moving snow. The victim, perhaps still attached to backpack, skis, and ski-poles, could follow only the very simplest of activating procedures.

Fourth, all previous emergency breathing devices depended on air supplied from the device itself, or on filtered atmospheric air. Pressurized cannisters of air or oxygen are too heavy to be carried by backcountry skiers, and atmospheric air is not directly available to the buried person. But virtually limitless quantities of unpolluted air in need of no filtering can slowly flow through snow itself. Failure to use that air because of reliance on other sources adds great complexity, risk of mechanical failure, and weight to the breathing device.

Accordingly, several objects and advantages of the present invention are: First, it is a very light, easily carried, breathing device. Second, it can be activated essentially instantly. Third, its activation procedure is so simple that even a severely panicked victim can use it. Fourth, it extracts air from snow, providing an air supply even if rescue requires many minutes to a few hours.

Further objects and advantages of the present device are that, first, it is made of widely-available and inexpensive materials. It is assembled easily. The device can be packaged for sale from sporting-goods and outdoor-gear shops. It can be manufactured and sold at a price acceptable to outdoor sportspersons, ski patrol groups, and other probable users. Still further objects and advantages will become apparent from consideration of the ensuing description and drawings.

SUMMARY OF THE INVENTION

This emergency breathing device is continuously worn over the jacket of the backcountry traveller. The device consists of (a) an inhalation membrane which permits passage of air from surrounding snow into (b) an inhalation chamber; (c) an exhalation membrane which permits passage of air from (d) an exhalation chamber into surrounding snow; (e) a mouthpiece for breathing; and (f) a system of tubes and one-way valves which convey exhaled air from the mouthpiece to the exhalation chamber, and which convey inhaled air from the inhalation chamber to the mouthpiece, and which keep inhaled and exhaled air substantially separated. If a snow burial occurs the traveller activates the device simply by breathing through the mouthpiece.

Figure 1:
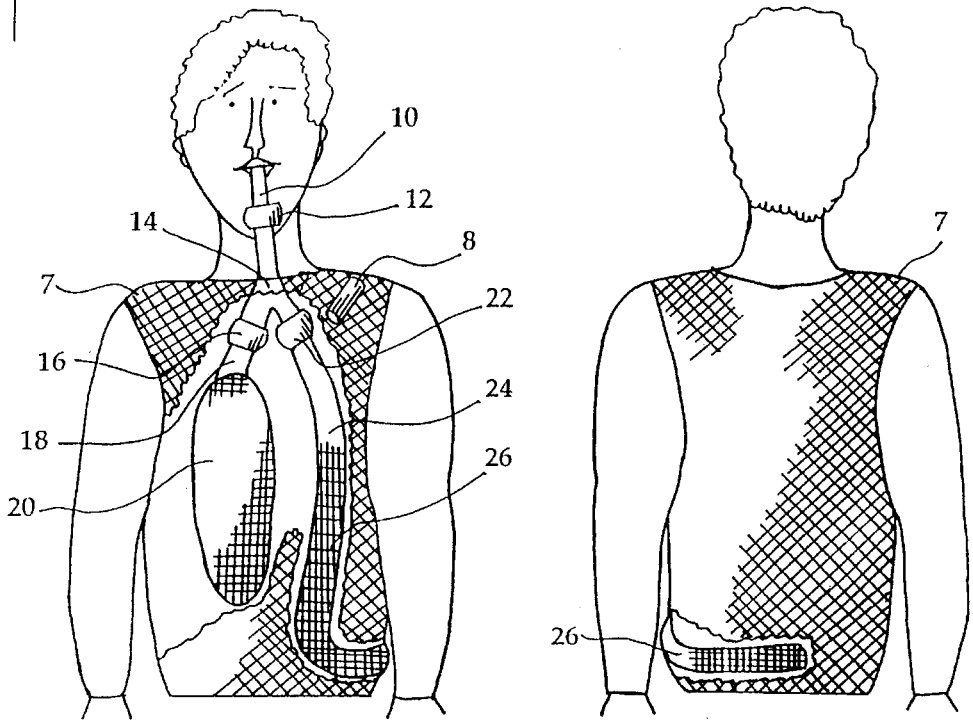
FIG. 1 is a perspective view showing the front and the back of a person wearing the breathing device. (A portion of the outer garment is not shown for purposes of clarity).

| Reference Numerals in Drawings | |
|---|---|
| 7 | Outer garment |
| 8 | Mouthpiece housing |
| 10 | Mouthpiece |
| 12 | Mouthpiece connecting tube |
| 14 | "Y" tubing connector |
| 16 | Inhalation one-way valve (flow toward mouthpiece) |

-continued

| Reference Numerals in Drawings | |
|---|---|
| 18 | Inhalation connecting tube |
| 20 | Inhalation chamber |
| 22 | Exhalation one-way valve (flow away from mouthpiece) |
| 24 | Exhalation connecting tube |
| 26 | Exhalation chamber |
| 32i & e | Protective mesh of inhalation and exhalation chambers |
| 34i & e | Inhalation and exhalation tubing |
| 36i & e | Holes of inhalation and exhalation chambers |
| 38i & e | Inhalation and exhalation membranes |

DESCRIPTION OF THE PREFERRED EMBODIMENT

A typical embodiment of this breathing device is shown in FIGS. 1 to 6. FIG. 1 shows a user wearing the device on a poncho-like outer garment 7, made, for example, of lightweight netting with quarter-inch holes. One example of such netting would be polyester netting mesh, such as that supplied by Outdoor Wilderness Fabrics, Nampa, Idaho. The user can move to his mouth a mouthpiece 10, normally secured in a tubular mouthpiece housing 8 at the shoulder. A mouthpiece connecting-tube 12 joins the mouthpiece 10 to "Y" tubing-connector 14. One arm of "Y" tubing-connector 14 joins to the inhalation one-way or check valve 16, which permits flow only toward mouthpiece 10. An inhalation connecting-tube 18 joins inhalation one-way valve 16 to inhalation chamber 20.

Exhalation one-way or check valve 22, which permits air flow only away from mouthpiece 10, mates to the remaining arm of "Y" tubing-connector 14. An exhalation connecting-tube 24 connects exhalation oneway valve 22 to exhalation chamber 26. Inhalation check valve 16 and exhalation check valve 22 are one-way valves permitting flow in one direction only and are of the type commonly known in the art.

Mouthpiece 10, "Y" tubing-connector 14, and one-way valves 16 and 22 may be, for example, similar in construction to those commonly used in respiratory care equipment. Examples of such materials are those supplied by Baxter Healthcare Corporation, Pharmaseal Division, Valencia, Calif. 91355, or by Hans Rudolph Incorporated, 7400 Wyandotte, Kansas City, Mo. 64114; however, here and elsewhere in this application, specifications of materials should not be construed as limiting the invention's scope, but merely as providing illustrations of some presently preferred embodiments. The mouthpiece connecting-tube 12, the inhalation connecting-tube 18, and the exhalation connecting-tube 24, are all flexible but crush resistant tubing, one example of which is disposable corrugated ethyl vinyl acetate, or EVA, tubing of Baxter Healthcare Corporation. The mouthpiece connecting-tube 12, the inhalation connecting-tube 18, and the exhalation connecting-tube 24 together form conducting means and are covered and reinforced with adhesive fabric tape, which also secures all joints in the system.

Figure 2:
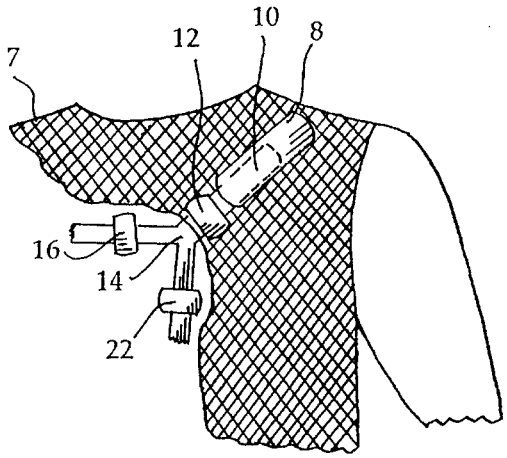
FIG. 2 is a perspective view showing the mouthpiece in place in the mouthpiece housing. (A portion of the outer garment is not shown for purposes of clarity).

FIG. 2 shows mouthpiece 10 in its pre-emergency position within mouthpiece housing 8, which has a tubular shape.

Figure 3:
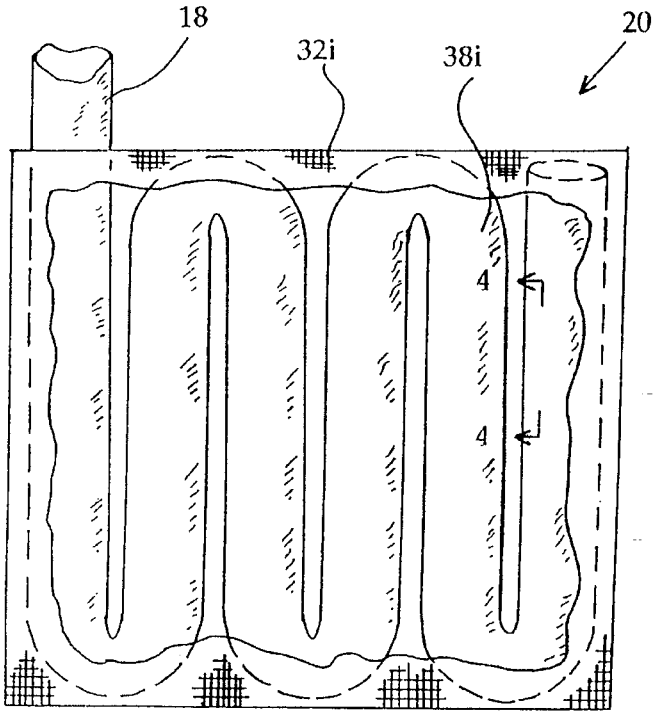
FIG. 3 is a plan view of the inhalation chamber. (A portion of the protective mesh is not shown for purposes of clarity).

FIG. 3 shows inhalation chamber 20 in greater detail. Inhalation connecting-tube 18 continues into inhalation chamber 20. The latter is covered by a protective mesh **32*i***, one example of which would be a porous nylon mesh available from Outdoor Wilderness Fabrics, Nampa, Idaho.

Figure 4:
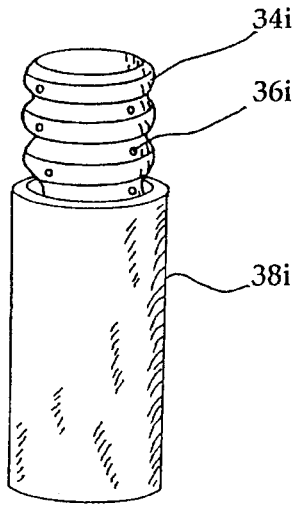
FIG. 4 is a sectional view of the inhalation chamber taken along lines 4—4 of FIG. 3 of the drawings.

FIG. 4 is an exploded view of the tubing within inhalation chamber 20, where the inhalation tubing **34*i* is not covered by fabric tape. Instead, many holes 36*i* puncture this tubing, which may be made, for example, of corrugated EVA tubing. A porous inhalation membrane 38*i* covers inhalation tubing 34*i*. Three layers of fine-mesh elastic nylon like, for example, that used in ladies'hose, comprise inhalation membrane 38*i*, which appears in FIGS. 3 and 4**.

Figure 5:
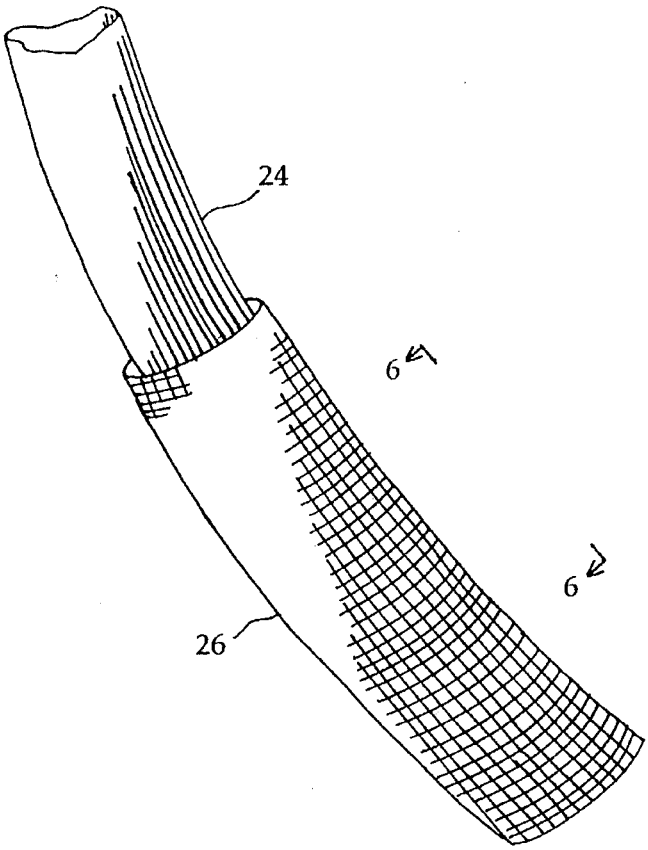
FIG. 5 is a plan view of the exhalation chamber.
Figure 6:
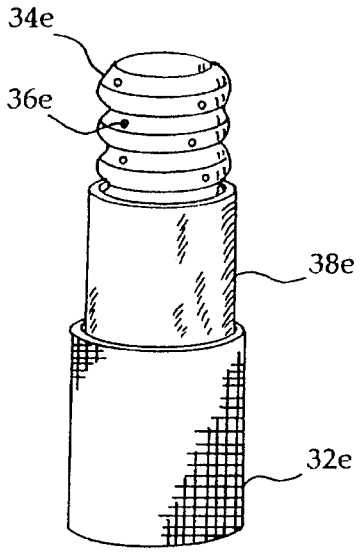
FIG. 6 is a sectional view of the exhalation chamber taken along lines 6—6 of FIG. 5 of the drawings.

FIG. 5 shows exhalation connecting-tube 24 continuing into exhalation chamber 26, where the tubing no longer is covered by tape. FIG. 6 shows an exploded view of exhalation chamber 26. There, the tubing becomes exhalation tubing **34*e*, punctured by many exhalation holes 36*e* and covered by porous exhalation membrane 38*e* made, for example, from three layers of hose-like nylon mesh. A protective mesh 32*e*, such as porous nylon mesh available from Outdoor Wilderness Fabrics, Nampa, Id., covers exhalation membrane 38*e***.

Operation: FIGS. 1–6

When passing through high-risk terrain, the backcountry traveller wears the net garment 7 which holds the breathing device. At the first sign of an approaching avalanche, or even while being swept along in one, the traveller moves mouthpiece 10 from mouthpiece housing 8 into his or her mouth and breathes through it.

During inspiration, inhalation one-way valve 16 opens and exhalation one-way valve 22 closes. Thus, inspired air travels from inhalation chamber 20 through inhalation connecting tube 18, inhalation one-way valve 16, "Y" connecting-tube 14, mouthpiece connecting-tube 12, and mouthpiece 10, into the mouth.

During expiration, inhalation one-way valve 16 closes and exhalation one-way valve 22 opens. Then, expired air travels from the mouth to mouthpiece 10, and then through mouthpiece connecting-tube 12,"Y" connecting-tube 14, exhalation one-way valve 22, exhalation connecting tube 24, and into exhalation chamber 26.

Expired air, in comparison to atmospheric air, has reduced oxygen and increased carbon dioxide concentrations. To minimize rebreathing of expired air, the device separates the course of incoming and outgoing air, starting from the two one-way valves (16 and 22) and extending to the inhalation and exhalation chambers (20 and 26). The "dead space" extending from the one-way valves (16 and 22) to the mouthpiece 10 does permit some mixing of inspired and expired air, but in the device this dead-space volume is kept small to minimize such mixing.

Inhalation tubing **34*i* is continuous with inhalation connecting tube 18. But unlike inhalation connecting tube 18, the former lacks an adhesive fabric cover. Moreover, many inhalation-chamber holes 36*i* permit air to enter inhalation tubing 34*i*. Several layers of fine nylon mesh, comprising the inhalation membrane 38*i*, ensheathe inhalation tubing 34*i*. These layers prevent snow from clogging inhalation holes 36*i*. The layers also present a large surface area to the surrounding snow, permitting influx of air from the snow into inhalation membrane 38*i* itself. From inhalation membrane 38*i*, air readily flows through inhalation holes 36*i* into the lumen of inhalation tubing 34*i*. A tough protective mesh 32*i* covers inhalation chamber 20. It prevents damage to the easily tom inhalation membrane 38*i*, but it does not block passage of air from snow into inhalation membrane 38*i***.

Similarly, exhalation connecting tube 24 is continuous with exhalation tube **34*e*. The exhalation membrane 38*e* covers exhalation tubing 34*e*, keeping snow from blocking exhalationchamber holes 36*e*. During expiration, air leaves the lumen of exhalation tube 34e through exhalation holes 36*e*. The air passes into exhalation membrane 38*e* , the large surface of which passes the air to the surrounding snow. Protective mesh 32*e* defends the exhalation membrane 38*e* from tears and snags, but does not block the passage of air from exhalation membrane 38*e*** into the snow.

Inhalation chamber 20 rests on the front of the user's chest, its inhalation tubing **34*i* coiled within it. Exhalation chamber 26 reaches around behind the user's hip, and its exhalation tubing 36*e* is not coiled. This arrangement places the inhalation and exhalation chambers 20 and 26 in contact with separate masses of snow, reducing the risk that exhaled air will be drawn back into inhalation chamber 20** to reach the user.

As much as 95 percent of the volume of new-fallen snow is air, although the air content may fall to about 50 percent as snow compacts in an avalanche. Under pressure air can flow through snow, but resistance from the lattice of snow crystals slows that flow, in comparison to flow rates in open atmosphere. A buried person's open mouth and nostrils present an area of approximately 15 square centimeters ($cm^2$) to the adjacent snow. With an average of about 12 breaths per minute divided about equally into inhalation and exhalation, inhalation duration usually is approximately 2.5 seconds. Inhalation volume is approximately 500 milliliters (ml) per inhalation. During inhalation, this works out to approximately 13 ml of air per second which a buried person must draw through each square cm of that lattice of snow crystals adjacent to nose and mouth (13 $ml/cm^2/second$). And unfortunately avalanches compact snow, reducing its air content, compressing the lattice of snow crystals, and increasing the resistance to air flow.

Respiration is carried out at low pressures. Pressures in lung alveoli normally range from −1 cm of water in inhalation to +1 cm of water in exhalation, which is quite adequate to move air in the normal atmosphere. But moving air through a resisting lattice of snow crystals at a rate of 13 $ml/cm^2/sec$ requires inhalation pressure gradients well beyond the physiologic capacity of chest wall and respiratory musculature.

Complicating the victim's problems even more, gasping for air may fill the nose and with snow, further increasing resistance to air flow. In addition water vapor in exhaled air may freeze, forming an ice mask in front of the face and further increasing flow resistance. Therefore, a person buried in snow often cannot inhale sufficient air to sustain life. Indeed, of persons buried 35 minutes, only 30 percent survive. Death comes to 97 percent of those buried 130 minutes.

These air-flow mechanics were very real to Wayne Slagle, an avalanche survivor quoted in 1986 by Betsy Armstrong and Knox Williams in "The Avalanche Book" published by Fulcrum Press. Slagle said that when the snow was moving "I was submerged. Each breath was extremely difficult. I was taking in a lot of snow." He said that when the slide finally stopped "My mouth was wide open gasping for air which did not come. My mouth and throat were packed firmly with snow."

But air-flow resistance is not the victim's only problem. Each exhalation deposits oxygendepleted, carbon-dioxide contaminated air into the snow near the nose and mouth. In snow this exhaled air does not diffuse away or blow away as it would in open atmosphere. Instead, with each exhalation more exhaled air accumulates in front of nose and mouth, and each inhalation draws back into the body increasing concentrations of this contaminated air.

Thus, each inspiration draws less than the required 500 ml of air. Moreover, oxygen concentration rapidly declines in that reduced volume while carbon dioxide concentration rises. Together, the reduced volume and the oxygen depletion cause death by asphyxiation.

The device described here alters these events, first, by permitting the victim to breath through a mouthpiece so that snow does not block the respiratory passages. Second, the device provides an inhalation chamber attached to an outer garment. If buried, the chamber's large, porous surface area interfaces with the snow. A box-shaped chamber just 4×2×11 inches has a surface of 1442 $cm^2$, an increase of more than 95-fold over the surface in front of the open mouth and nose. For 500 ml of air to enter this chamber in a 2.5 sec inhalation, the flow rate need be only about 0.14 $ml/cm^2/sec$, a 95-fold reduction in flow rate per $cm^2$. Through trial and error in field tests, I arrived at approximately that size for an inhalation chamber. The tests demonstrated that pulmonary muscles produce pressure gradients which achieve this flow rate through snow; i.e., a person can inhale for prolonged periods through such a box buried in packed snow.

Third, the invention provides an exhalation chamber with a similarly large, porous surface. The victim blows exhaled air into the snow through that large surface. Again, the flow rates per $cm^2$ are low enough that pressures normally produced by pulmonary muscles easily exhale the required volumes for prolonged periods. Trial-and-error tests indicate that a tubular exhalation chamber about 26 inches long, with an outside circumference of about 4 inches, permits easy exhalation even into compacted snow.

Fourth, the exhalation chamber rests on the person's outerwear at some distance from the inhalation chamber, as shown in FIG. 1. Thus, air entering the inhalation chamber from the snow includes little or no previously exhaled air.

In a field test of the described device done at an altitude of about 11,000 feet, a surface crew fully buried me beneath 2–3 feet of compacted snow. I had an intercom system for communication with the crew. Wearing the device, I easily breathed for about 40 minutes, and could have continued breathing longer. However, I asked to be dug out at that time because of the considerable psychological and physical discomfort of being immobilized beneath the snow, and because I was becoming chilled. These conditions closely simulated an actual avalanche burial, in which about half of victims die after burial to a depth of just 2 feet. Considering only time, about 70 percent of avalanche victims reportedly are dead at just 35 minutes, and I was fully awake and breathing easily at 40 minutes.

SUMMARY,RAMIFICATIONS,AND SCOPE

It is apparent that this device achieves the objects and advantages set out above. The device is very light, so that backcountry travellers really can carry it. Its activation is extremely simple and rapid, needing only the shifting of the mouthpiece from its housing on the shoulder to the user's mouth. Therefore, the device can be used by a severely panicked person, even while being swept along in an avalanche. It does not rely on pressure-reduction valves, compressed air tanks, chemical oxygen supplies, or other material which backcountry skiers would find difficult to carry or possibly contrary to wilderness esthetics. The device extracts air directly from snow, assuring a virtually endless supply of air. It minimizes mixing of inhaled and exhaled air. Its mechanical simplicity, and the ready availability of its parts, makes it easy and inexpensive to manufacture, distribute, and operate, increasing the likelihood of its use.

Although the description above contains many specificities, these should not be construed as limiting the invention's scope, but as merely providing illustrations of presently preferred embodiments. Other envisioned embodiments include, but are not limited to:

(a) The inhalation and exhalation chambers (20 and 26) could be made in many shapes. For example, rather than being built around punctured tubes, they could be formed from hollow, perforated, box-shaped structures, or from hollow, perforated, flattened cylinders (shaped like hockey pucks). Even a thin flat plate, deformed into waves, with a membrane stretched tight around it, could serve as an inhalation or exhalation chamber.

(b) Inhalation and exhalation membranes (**38*i* and 38*e***) could be made of any material permeable to air but impermeable to snow. Examples include (but are not limited to) other cloth fabrics, various metal or plastic screens, or porous cellular foams.

(c) The inhalation and exhalation membranes (**38*i* and 38*e*) themselves, if sufficiently firm and sufficiently permeable to air, could extend inward to form the core of the inhalation and exhalation chambers (20 and 26), replacing the hollow cavity of those chambers. That is to say, the mass of the inhalation and exhalation membranes (38*i* and 38*e*) themselves could totally comprise, respectively, the inhalation and exhalation chambers (20 and 26**).

(d) The device could be attached by simple means to the user's own clothing, instead of incorporating the poncho-like outer garment 7.

(e) The poncho-like outer garment 7 could instead be shaped like a sweater, vest, or other appropriate article of clothing.

(f) Outer garment 7 could hold inhalation chamber 20, exhalation chamber 26, mouthpiece housing 8, mouthpiece 10, and mouthpiece connecting tube 12, as shown in FIG. 1. But all other parts, connected in the same order shown in FIG. 1, could be arranged to lie beneath the users's own jacket or sweater. This arrangement would reduce the risk that moisture in exhaled air would freeze and block exhalation one-way valve 22. The disadvantage of this ramification would be that donning the device would be somewhat less convenient. Furthermore, the advantage of this ramification may be mostly theoretical, since my field test showed that for at least 40 minutes of burial, the valve does not freeze.

(g) A pump situated between inhalation chamber 20 and mouthpiece 10 could blow air toward the user's mouth. Increased inhalation flow volumes would be the resultant advantage, but increased weight and mechanical complexity would be major disadvantages. Thus, this modification is clearly less advantageous than that given above in the Description of the Preferred Embodiment.

(h) The device could be simplified by eliminating parts related to its exhalation function. In this embodiment inhalation chamber 20 would be connected directly to mouthpiece 10 by inhalation tube 18. All other parts would be eliminated. The advantages are the elimination of several parts, including the only moving parts, the one-way valves. This reduces mechanical complexity, weight, and manufacturing costs. But this embodiment requires that the user inhale through mouthpiece 10 and then exhale directly into the snow around mouthpiece 10 or through the nose. This may be too difficult for an injured or semi-comatose user. Also, direct exhalation into heavy, wet, or densely packed snow requires great effort and could not be continued for long. Furthermore, if a frozen ice mask formed in front of the face as described above, exhalation might become impossible. Thus, this modification is clearly less advantageous than that given above in the Description of the Preferred Embodiment.

Thus the scope of the invention should be determined by the appended claims and their legal equivalents, rather than by the examples given.

I claim:

1. An emergency breathing device for a person buried in snow, the snow having breathable air contained therein, comprising:

(a) an inhalation chamber;

(b) an inhalation membrane permeable by air but substantially impermeable by snow covering the inhalation chamber, the inhalation membrane preventing snow from entering the inhalation chamber, the inhalation membrane having a surface area sufficient to allow air to enter the inhalation chamber;

(c) an inhalation connecting tube having a lumen, the inhalation connecting tube connected to the inhalation chamber, wherein air is conveyed from the inhalation chamber through the lumen of the inhalation connecting tube;

(d) an inhalation check valve connected to the inhalation connecting tube, wherein the inhalation check valve permits air to flow from the lumen of the inhalation connecting tube through the inhalation check valve;

(e) a Y-shaped tubing connector having a mouthpiece connecting tube and arms, one arm of the Y-shaped tubing connector connected to the inhalation check valve, wherein air passes from the inhalation check valve to the mouthpiece connecting tube;

(f) an exhalation check valve connected to a remaining arm of the Y-shaped tubing connector, wherein the exhalation check valve permits air to flow from the mouthpiece connecting tube to the remaining arm of the Y-shaped tubing connector and through the exhalation check valve;

(g) an exhalation connecting tube having a lumen, the exhalation connecting tube connected to the exhalation check valve, wherein air is conveyed from the exhalation check valve to the lumen of the exhalation connecting tube;

(h) an exhalation chamber connected to the exhalation connecting tube; and (i) an exhalation membrane permeable by air but substantially impermeable by snow covering the exhalation chamber, the exhalation membrane preventing snow from entering the exhalation chamber, the exhalation membrane having a surface area sufficient to pass air from the exhalation chamber;

whereby air trapped within snow burying a user is drawn through the inhalation membrane, inhalation chamber, inhalation connecting tube, inhalation check valve and to the mouthpiece connecting tube responsive to inhalation by the user, and whereby air exhaled by the user is conveyed through the mouthpiece connecting tube, exhalation check valve, exhalation connecting tube, exhalation chamber, exhalation membrane and into snow wherein exhaled air is not re-breathed by the user.

2. The emergency breathing device defined in claim 1 wherein the exhalation membrane is fine mesh material.

3. The emergency breathing device defined in claim 1 wherein the exhalation chamber is flexible and crush resistant tubing perforated with a plurality of holes.

4. The emergency breathing device defined in claim 1 wherein the inhalation membrane is fine mesh material.

5. The emergency breathing device defined in claim 1 wherein the inhalation chamber is flexible and crush resistant tubing perforated with a plurality of holes.

6. The emergency breathing device defined in claim 1 further comprising a mouthpiece connected to the mouthpiece connecting tube, wherein the mouthpiece is used by a person buried in snow to utilize the emergency breathing device to breath.

7. The emergency breathing device defined in claim 1 further comprising protective mesh covering the inhalation chamber and the exhalation membrane.

8. The emergency breathing device defined in claim 1 further comprising an outer garment wherein the membranes, chambers, check valves and connecting tubes are attached to the outer garment.

9. The emergency breathing device defined in claim 8 further comprising a mouthpiece housing attached to the outer garment.

10. An emergency breathing device for a person buried in snow, the snow having breathable air contained therein, comprising:

(a) a mouthpiece,:

(b) conducting means having a lumen, mouthpiece connecting tube and arms, the mouthpiece connecting tube connected to the mouthpiece, wherein air is conveyed through the lumen of the conducting means;

(c) an inhalation chamber connected to one arm of the conducting means;

(d) an inhalation check valve positioned between the mouthpiece and the inhalation chamber;

(e) an inhalation membrane permeable by air but substantially impermeable by snow covering the inhalation chamber, the inhalation membrane having a surface area sufficient to allow air to enter the inhalation chamber;

(f) an exhalation chamber connected to a remaining arm of the conducting means;

(g) an exhalation check valve positioned between the mouthpiece and the exhalation chamber; and (h) an exhalation membrane permeable by air but substantially impermeable by snow covering the exhalation chamber, the exhalation membrane having a surface area sufficient to pass air from the exhalation chamber;

whereby air trapped within snow burying a user is drawn through the inhalation membrane, inhalation chamber, one arm of the conducting means and inhalation check valve to the mouthpiece responsive to inhalation by the user, and whereby air exhaled by the user through the mouthpiece is conveyed through the exhalation check valve, remaining arm of the conducting means, exhalation chamber, exhalation membrane and into snow wherein exhaled air is not re-breathed by the user.

11. The emergency breathing device defined in claim 10 wherein the conducting means is flexible and crush resistant tubing formed in a Y shape incorporating a check valve in one arm permitting air to flow from the inhalation chamber to the mouthpiece and in the remaining arm permitting air to flow from the mouthpiece to the exhalation chamber.

12. The emergency breathing device defined in claim 1 wherein the inhalation membrane is fine mesh material.

13. The emergency breathing device defined in claim 1 wherein the inhalation chamber is flexible and crush resistant tubing perforated with a plurality of holes.

14. The emergency breathing device defined in claim 1 wherein the exhalation chamber is flexible and crush resistant tubing perforated with a plurality of holes.

15. The emergency breathing device defined in claim 10 wherein the exhalation membrane is fine mesh material.

16. The emergency breathing device defined in claim 10 further comprising protective mesh covering the inhalation chamber and the exhalation membrane.

17. The emergency breathing device defined in claim 10 further comprising an outer garment wherein the membranes, chambers, check valves and connecting tubes are attached to the outer garment.

18. The emergency breathing device defined in claim 17 further comprising a mouthpiece housing attached to the outer garment.

* * * * *